US009800009B2

(12) United States Patent
Stull et al.

(10) Patent No.: US 9,800,009 B2
(45) Date of Patent: Oct. 24, 2017

(54) CRIMPING DEVICE WITH SEAL DEPRESSOR

(71) Applicants: Tyco Electronics Corporation, Berwyn, PA (US); Tyco Electronics UK, Ltd., Wiltshire (GB); Tyco Electronics AMP GmbH, Bensheim (DE)

(72) Inventors: David Michael Stull, Etters, PA (US); Matt J. Clifford, Somerset (GB); Guenter Sowa, Nieder-Olm (DE)

(73) Assignees: TE CONNECTIVITY CORPORATION, Berwyn, PA (US); TE CONNECTIVITY GERMANY GMBH, Bensheim (DE); TYCO ELECTRONICS UK, LTD., Swindon (GB)

( * ) Notice: Subject to any disclaimer, the term of this patent is extended or adjusted under 35 U.S.C. 154(b) by 273 days.

(21) Appl. No.: 14/610,151

(22) Filed: Jan. 30, 2015

(65) Prior Publication Data

US 2016/0226208 A1 Aug. 4, 2016

(51) Int. Cl.
*H01R 43/048* (2006.01)

(52) U.S. Cl.
CPC ..... *H01R 43/0488* (2013.01); *H01R 43/048* (2013.01)

(58) Field of Classification Search
CPC ..... H01R 4/185; H01R 43/048; H01R 4/62; H01R 4/20; H01R 9/0518; H01R 43/005; H01R 4/188; H01R 4/18; H01R 13/52; H01R 4/70; H01R 13/5216; H01R 13/5219
USPC ..... 29/748, 751–753
See application file for complete search history.

(56) References Cited

U.S. PATENT DOCUMENTS

| | | | |
|---|---|---|---|
| 5,295,865 | A | 3/1994 | Endo et al. |
| 2001/0045008 | A1 | 11/2001 | Fukase |
| 2002/0069520 | A1 | 6/2002 | Erisman et al. |

FOREIGN PATENT DOCUMENTS

| | | | |
|---|---|---|---|
| CA | 1196402 | | 11/1985 |
| JP | 07312813 A | * | 11/1995 |
| JP | H07 312813 A | | 11/1995 |
| JP | 07326457 A | * | 12/1995 |

(Continued)

OTHER PUBLICATIONS

Original document and Machine translation of JP07326457A are attached.*

(Continued)

*Primary Examiner* — Peter DungBa Vo
*Assistant Examiner* — John S Lowe

(57) ABSTRACT

A terminal crimping device includes crimp tooling and a seal depressor fixed to the crimp tooling. The crimp tooling and the seal depressor move with a movable ram along a crimp stroke towards and away from a base that receives a wire assembly and a terminal thereon. The crimp tooling crimps the terminal to both a wire and a compression seal of the wire assembly during the crimp stroke. The seal depressor has a contact tab that engages and at least partially depresses the compression seal of the wire assembly during the crimp stroke to hold the compression seal in place as the crimp tooling crimps the terminal to the wire assembly.

20 Claims, 5 Drawing Sheets

(56) References Cited

FOREIGN PATENT DOCUMENTS

JP H07 326457 A 12/1995

OTHER PUBLICATIONS

Original document and Machine translation of JP07312813A are attached.*
International Search Report, International Application No. PCT/US2015/066629, International Filing Date, Dec. 18, 2015.

* cited by examiner

CRIMPING DEVICE WITH SEAL DEPRESSOR

BACKGROUND OF THE INVENTION

The subject matter herein relates generally to terminal crimping devices for crimping electrical terminals to wires.

Terminal crimping machines have long been used in the connector industry to effect high-speed mass termination of various cables. It is common practice for the terminal crimping machine to have an interchangeable tooling assembly called an applicator. In general, such terminal crimping machines are referred to as a terminator or press; however other types of terminal crimping machines may similarly be used, such as a lead maker, a bench machine, or a hand crimping tool. The terminal crimping machines includes a movable tool that is moved towards a base component during a crimping stroke to crimp a terminal on the base component to an end of a wire, producing an electrical lead.

The electrical lead is typically assembled into an electrical connector, which may be part of a wire harness. Some electrical connectors are expected to be exposed to harsh environmental conditions in use, such as for connectors on automobiles, trains, boats, and the like. The harsh environmental conditions, such as the presence of dirt, sand, debris, liquids, radiation, heat, cold, corrosive elements, vibration, pressure, or the like, have a proclivity to interfere with the crimped connection between the terminal and the wire, possibly resulting in a faulty connection between the wire and the electrical connector. To protect the crimped connection from the harsh environmental conditions, the leads on some electrical connectors have compression seals that are designed to seal the wire of the lead to the housing of the electrical connector to prevent debris, contaminants, and other harsh environmental conditions from affecting the crimped connection within the housing, thus preserving the electrical connection between the wire and the electrical connector. The seals are typically sandwiched between the wire and a portion of the terminal during the crimping operation to fix the seal in place on the electrical lead.

Known terminal crimping machines are not without disadvantages, especially when used to produce electrical leads that have compression seals. For instance, as the movable tool moves towards the terminal on the base component to form the terminal around the wire and the compression seal, the forces at play may cause the compression seal to move axially along the wire away from the distal end of the wire, to roll back onto itself, to twist, to move radially, or the like. Such movement of the compression seal is undesired because it may prevent the terminal from crimping properly to the seal and wire, it may damage the compression seal, and/or it may misalign the seal with the wire. Each situation may compromise the effectiveness of the compression seal at sealing the wire to the housing of the electrical connector, resulting in a leak path across the seal that could allow the harsh environmental conditions to interfere with the crimped connection of the lead.

A need remains for terminal crimping machine that does not damage or misalign the compression seals on the wires during the crimping process.

BRIEF DESCRIPTION OF THE INVENTION

In one embodiment, a terminal crimping device is provided that crimps a terminal to a wire assembly. The wire assembly includes a wire and a compression seal on the wire. The terminal crimping device includes crimp tooling and a seal depressor fixed to the crimp tooling. The crimp tooling is on a movable ram. The crimp tooling moves with the movable ram along a crimp stroke towards and away from a base that receives the wire assembly thereon. The crimp tooling crimps the terminal to both the wire and the compression seal of the wire assembly during the crimp stroke. The seal depressor moves with the crimp tooling along the crimp stroke. The seal depressor has a contact tab that engages and at least partially depresses the compression seal of the wire assembly during the crimp stroke to hold the compression seal in place as the crimp tooling crimps the terminal to the wire assembly.

Optionally, the seal depressor is adjustable relative to the crimp tooling along a ram axis from a first operative position relative to the crimp tooling to a second operative position relative to the crimp tooling to adjust a bottom dead center position of the seal depressor along the crimp stroke.

In another embodiment, a crimping system is provided that includes a wire assembly and a terminal crimping device. The wire assembly has a wire and a compression seal on the wire. The terminal crimping device crimps a terminal to the wire assembly. The terminal crimping device includes a base, crimp tooling, and a seal depressor. The base receives the wire assembly thereon. The crimp tooling is on a movable ram. The crimp tooling moves with the movable ram along a crimp stroke towards and away from the base. The crimp tooling forms the terminal around both the wire and the compression seal of the wire assembly during the crimp stroke. The seal depressor is fixed to the crimp tooling. The seal depressor moves with the crimp tooling along the crimp stroke. The seal depressor has a contact tab that engages and at least partially depresses the compression seal of the wire assembly during the crimp stroke to hold the compression seal in place as the crimp tooling forms the terminal around the wire assembly.

DETAILED DESCRIPTION OF THE INVENTION

Figure 1:
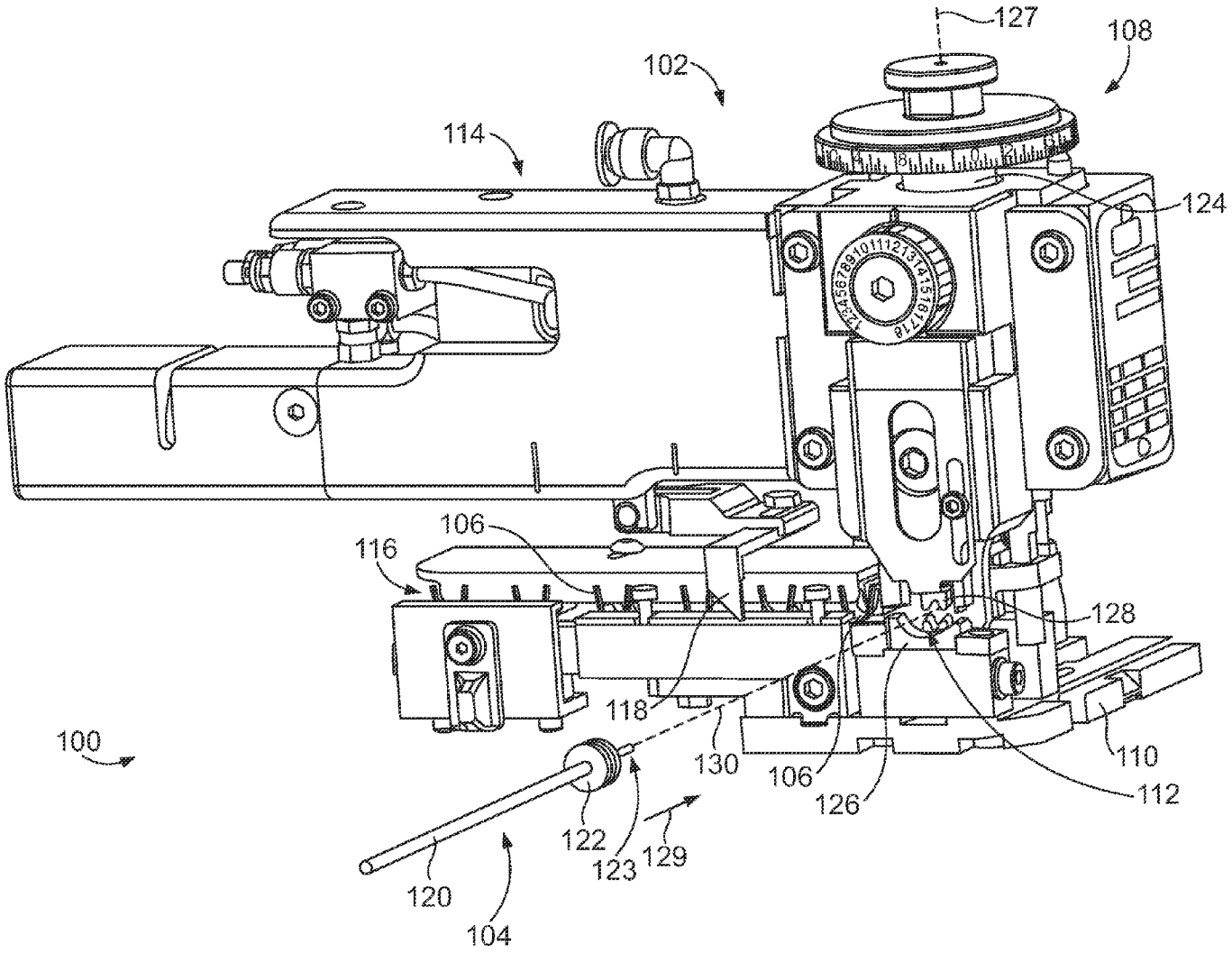
FIG. 1 is a front perspective view of a crimping system including a terminal crimping device and a wire assembly poised for loading into the terminal crimping device for crimping a terminal onto the wire assembly.

FIG. 1 is a front perspective view of a crimping system 100 including a terminal crimping device 102 and a wire assembly 104 poised for loading into the terminal crimping device 102 for crimping a terminal 106 onto the wire assembly 104. The terminal crimping device 102 is configured to crimp terminals 106 onto wire assemblies 104 to produce electrical leads for use in electrical connectors. The terminal crimping device 102 is part of a terminal crimping machine (not shown). The terminal crimping machine may be a terminator or press that actuates or controls the terminal crimping device 102, such as by providing the motive force for the crimping process or operation. Alternatively, the terminal crimping device may be used in other types of terminal crimping machines, such as lead makers, bench machines, and the like.

In the illustrated embodiment, the terminal crimping device 102 includes an applicator 108 and a terminal feeder 114. The applicator 108 is the termination tool that mechanically forms a terminal 106 around a corresponding wire assembly 104 during each crimping operation. The applicator 108 is coupled to a frame 110 of the terminal crimping device 102. Alternatively, the frame 110 may be a component of the applicator 108 instead of a separate component to which the applicator 108 is coupled. The applicator 108 defines a crimping zone 112. One terminal 106 and one wire assembly 104 are each independently fed to the crimping zone 112 for each crimping operation, and the terminal 106 is crimped to the wire assembly 104 in the crimping zone 112. The applicator 108 may be removed and replaced with a different applicator, such as when a different size/type of terminal 106 is used, when a different size/type of wire assembly 104 is to be terminated, when the applicator 108 is worn or damaged, or when an applicator having a different configuration is desired. For example, the applicator 108 in the illustrated embodiment has a side-feed configuration such that the terminals 106 are fed transverse relative to the direction the wire assemblies 104 are fed. The applicator 108 may be substituted with a different applicator having a longitudinal-feed configuration such that the terminals 106 are fed in a direction in-line with the wire assemblies 104. As such, multiple different applicators may be used with the terminal crimping device 102, and the different applicators may have different set-up configurations.

The terminal feeder 114 is coupled to the applicator 108 and is used to feed the terminals 106 to the crimping zone 112. The terminal feeder 114 may be an electrically actuated feeder, a pneumatic feeder, a cam and linkage feeder, or the like, depending on the type of terminal crimping device 102. The terminals 106 may be coupled to a carrier strip (not shown), forming a terminal strip 116. The terminal feeder 114 includes a feeder arm 118 that engages the terminal strip 116 to advance the terminal strip towards the crimping zone 112.

The wire assembly 104 includes a wire 120 and a compression seal 122. The compression seal 122 is on the wire 120 and located near a distal end 123 of the wire 120. The compression seal 122 at least partially surrounds the wire 120. In the illustrated embodiment, the compression seal 122 fully surrounds the perimeter of the wire 120 along the length of the compression seal 122. The compression seal 122 is used to seal the wire assembly 104 to a housing of an electrical connector (not shown). For example, the electrical connector may be designed to withstand harsh environmental conditions, such as dirt, sand, debris, liquids, radiation, heat, cold, corrosive elements, vibration, pressure, or the like. The seal 122 prevents (or at least prohibits) the harsh environmental conditions from interfering with the electrical connections between the wire 120, the terminal 106, and the connector. The wire assemblies 104 are advanced in a wire loading direction 129 along a wire axis 130 towards the crimping zone 112. Although not shown, a wire feeder may be used to advance each wire assembly 104 towards the crimping zone 112.

The applicator 108 of the terminal crimping device 102 includes a ram 124 and a base 126. During a crimping operation, the ram 124 is actuated or driven through a crimp stroke by a driving mechanism or actuator (not shown) of the terminal crimping machine (not shown). The actuator may be a motor having a crank shaft that moves the ram 124. Alternatively, the actuator may be a linear actuator, a piezoelectric actuator, a pneumatic actuator, or the like. The ram 124 is moved along a ram axis 127 in an advancing direction and a retracting direction relative to the base 126 during the crimp stroke. The base 126 receives the terminal 106 and the wire assembly 104 in the crimping zone 112, where the terminal 106 is crimped to the wire assembly 104. The base 126 at least partially defines the crimping zone 112. Optionally, at least part of the base 126 is stationary throughout the crimp stroke of the ram 124.

The terminal crimping device 102 further includes crimp tooling 128 on the ram 124. The crimp tooling 128 is coupled to the ram 124 such that the crimp tooling 128 moves with the ram 124 along the ram axis 127 during the crimp stroke towards and away from the base 126. The crimp tooling 128 is configured to mechanically crimp the terminal 106 in the crimping zone 112 to the wire assembly 104 during the crimp stroke. For example, the crimp tooling 128 engages the terminal 106 and forms or crimps the terminal 106 around the wire assembly 104 such that the terminal 106 locks onto the wire assembly 104. In an exemplary embodiment, the crimp tooling 128 crimps the terminal 106 to both the wire 120 and the compression seal 122 of the wire assembly 104, which fixes both the seal 122 and the terminal 106 to the wire 120.

Figure 2:
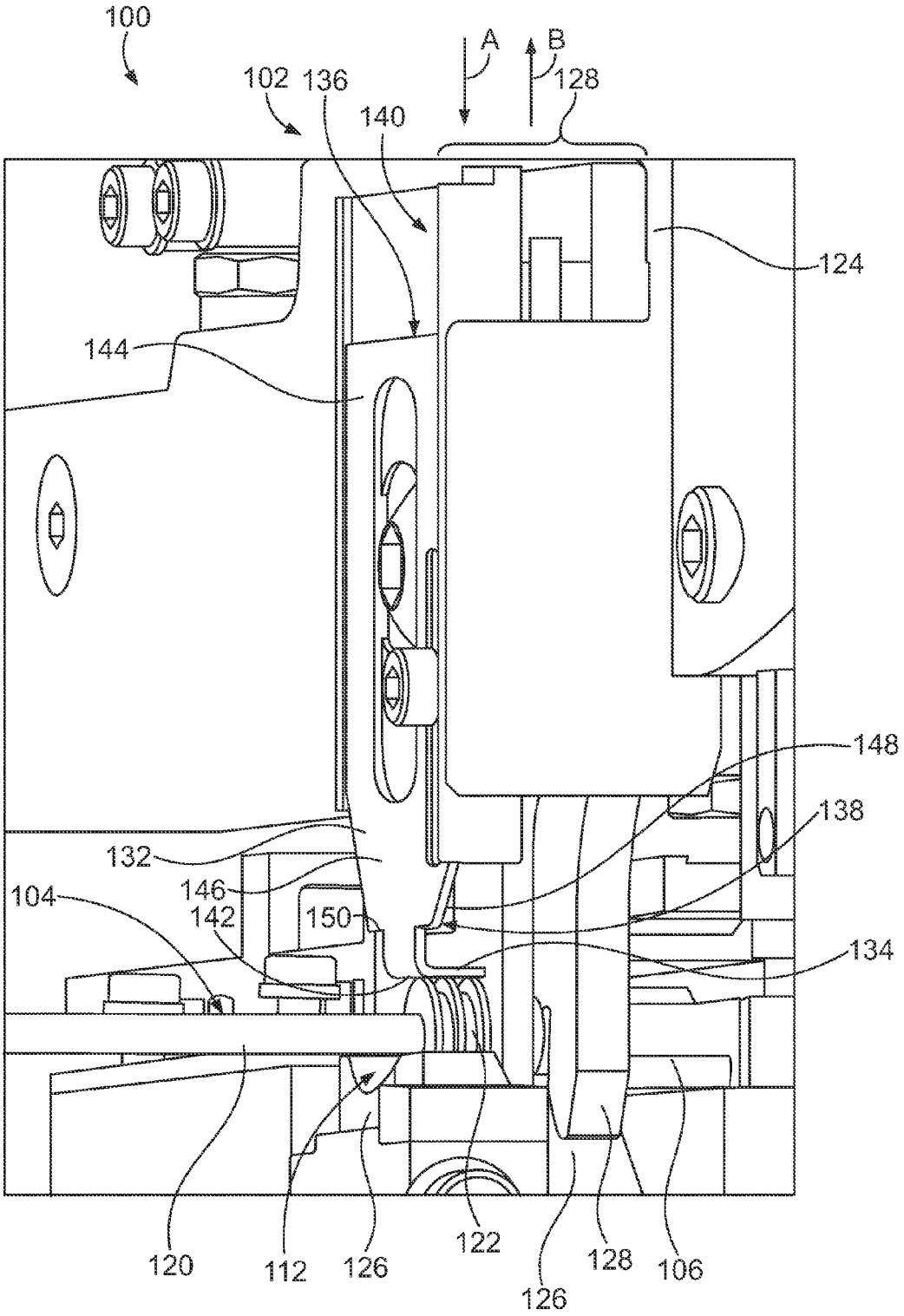
FIG. 2 is a close-up side perspective view of a portion of the crimping system during a crimping operation according to an embodiment.

FIG. 2 is a close-up side perspective view of a portion of the crimping system 100 during a crimping operation according to an embodiment. In the illustrated embodiment, a wire assembly 104 and a terminal 106 are in the crimping zone 112, and the crimp tooling 128 is in a crimping state in which the crimp tooling 128 engages the terminal 106 to form the terminal 106 around the wire assembly 104. The crimp tooling 128 on the ram 124 is cyclically driven through the crimp stroke from a released state at a top of the crimp stroke to the crimping state at a bottom of the crimp stroke, and then returns to the released state. The crimp stroke has both an advancing or downward component, shown by the arrow A, and a return or upward component, shown by the arrow B. In the released state, the crimp tooling 128 is positioned away from the base 126 and not in contact with the terminal 106, such that the terminal 106 is released from the crimp tooling 128.

During operation, the crimp tooling 128 in the released state is advanced downward toward the base 126 to an initial terminal contact position, in which the crimp tooling 128 initially contacts the terminal 106, such that the crimp tooling 128 enters the crimping state. The crimp tooling 128 continues downward in the advancing direction to a bottom dead center position, which is the bottom-most position along the crimp stroke. Throughout the crimp stroke, the crimp tooling 128 is most proximate to the base 126 at the bottom dead center position. As the crimp tooling 128 is advanced from the initial terminal contact position to the bottom dead center position, the crimp tooling 128 transitions through a crimp forming stage of the crimp stroke. The crimp tooling 128 changes the shape of the terminal 106, forming the terminal 106 around the wire assembly 104, during the crimp forming stage. The crimping of the terminal 106 to the wire assembly 104 occurs during the downward component of the crimp stroke. The crimp tooling 128 then returns upward to the top of the crimp stroke. At some point during the upward component of the crimp stroke, the crimp tooling 128 separates from the terminal 106, and the crimp tooling 128 enters the released state. In the illustrated embodiment, the crimp tooling 128 is in the crimp forming stage.

The terminal crimping device 102 further includes a seal depressor 132 that is fixed to the crimp tooling 128. The seal depressor 132 moves with the crimp tooling 128 along the crimp stroke. The seal depressor 132 has a contact tab 134 that engages and at least partially depresses the compression seal 122 of the wire assembly 104 during the crimp stroke to hold the compression seal 122 in place as the crimp tooling 128 crimps the terminal 106 to the wire assembly 104. For example, as the seal depressor 132 moves downward with the crimp tooling 128 in the advancing direction, the contact tab 134 initially contacts the compression seal 122 at an initial seal contact position of the seal depressor 132. Like, the crimp tooling 128, the seal depressor 132 continues downward in the advancing direction to a bottom dead center position, which is the bottom-most position along the crimp stroke for the seal depressor 132. Since the seal depressor 132 is fixed to the crimp tooling 128, the seal depressor 132 and the crimp tooling 128 both reach the respective bottom dead center positions at the same time during the crimp stroke, although the seal depressor 132 at the bottom dead center position may have a different vertical height relative to the frame 110 (shown in FIG. 1) of the terminal crimping device 102 than the crimp tooling 128.

The seal depressor 132 may capture the compression seal 122 between the contact tab 134 above and the base 126 below. As the seal depressor 132 moves from the initial seal contact position to the bottom dead center position, the contact tab 134 at least partially depresses the compression seal 122. The force from the seal depressor 132 on the compression seal 122 serve to hold the seal 122 in place relative to the wire 120, to the terminal 106, and to the terminal crimping device 102 during the crimping operation. The force from the seal depressor 132 assures that the seal 122 does not fold back, twist, or move axially along the wire 120 in response to the crimping forces. Thus, the seal depressor 132 holds the compression seal 122 in position during the crimping operation such that the terminal 106 can be properly crimped onto the seal 122, producing an electrical lead that meets specifications. At some point during the upward component of the crimp stroke, after the terminal 106 is crimped to the wire assembly 104, the contact tab 134 separates from the compression seal 122.

The seal depressor 132 has a top end 136 and a bottom end 138. As used herein, relative or spatial terms such as "top," "bottom," "front," "rear," "left," and "right" are only used to distinguish the referenced elements and do not necessarily require particular positions or orientations in the crimping system 100 or in the surrounding environment of the crimping system 100. The bottom end 138 is more proximate to the base 126 than the top end 136. The contact tab 134 is disposed at least proximate to the bottom end 138. Optionally, the contact tab 134 is at the bottom end 138. The seal depressor 132 is coupled to a front 140 of the crimp tooling 128. The contact tab 134 extends rearward from the seal depressor 132 towards the crimp tooling 128 and/or the ram 124. A bottom surface 142 of the contact tab 134 engages the compression seal 122 during at least the crimp forming stage. The bottom surface 142 of the contact tab 134 is smooth and lacks any apertures or sharp points that could damage the material of the seal 122. In the illustrated embodiment, the contact tab 134 is flat. In an alternative embodiment shown in FIG. 4, the contact tab 134 has a concave curve relative to the base 126. The contact tab 134 may have other shapes in other embodiments.

In an embodiment, the seal depressor 132 has a planar body 144 that includes a front face 146 and an opposite rear face 148. The rear face 148 faces the crimp tooling 128. The contact tab 134 extends from a bottom edge 150 of the body 144. The contact tab 134 extends at least partially rearward out of the plane of the body 144. For example, the contact tab 134 may extend downward and rearward from the bottom edge 150, as shown in FIG. 2, or rearward only. In an alternative embodiment, the seal depressor 132 is positioned rearward of at least some of the crimp tooling 128, and the contact tab 134 extends frontward from the seal depressor 132, such as across one or more components of the crimp tooling 128 (through openings in the components, for example).

Figure 3:
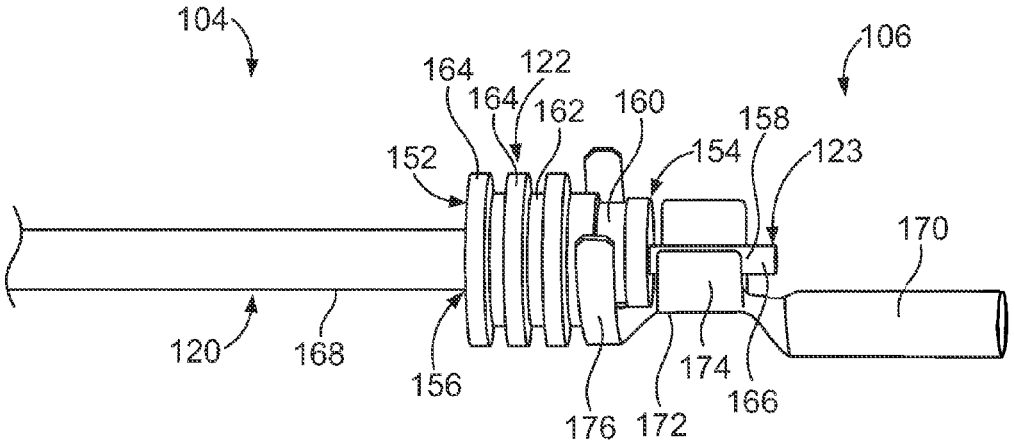
FIG. 3 is a side perspective view of the wire assembly loaded on a terminal according to an embodiment.

FIG. 3 is a side perspective view of the wire assembly 104 loaded on a terminal 106 and poised for crimping according to an embodiment. The compression seal 122 has a first end 152 and a second end 154. A channel 156 extends through the seal 122 between the first and second ends 152, 154. The wire 120 extends through the channel 156 and a distal portion 158 of the wire 120 that includes the distal end 123 protrudes from the second end 154.

The compression seal 122 includes a crimp segment 160 that extends to the second end 154 and a plug segment 162 that extends to the first end 152. The crimp segment 160 of the compression seal 122 is more proximate to the distal end 123 of the wire 120 than the plug segment 162. The crimp segment 160 is configured to be crimped to the terminal 106 during the crimping operation, such that a portion of the terminal 106 is formed around and engages the crimp segment 160. The plug segment 162 has a greater diameter than the crimp segment 160. The plug segment 162 is used for sealing the wire assembly 104 to an opening in a housing of an electrical connector. For example, the plug segment 162 engages edges of the opening in a connector to seal the space between the wire 120 and the edges of the opening. The plug segment 162 optionally includes multiple ribs 164 along an outer perimeter of the plug segment 162. During the crimping operation, the contact tab 134 of the seal depressor 132 (both shown in FIG. 2) engages the plug segment 162.

The compression seal 122 may be formed of rubber or a rubber-like material or compound. The compression seal 122 is at least partially compressible. The wire 120 includes a conductive metal core 166 that is surrounded by an insulator layer 168. The insulator layer 168 does not cover (for example, is stripped from) the core 166 along the distal portion 158 of the wire 120, which allows for an electrical connection between the core 166 and the terminal 106 during the crimping operation.

The terminal 106 is electrically conductive and is at least partially formed of a conductive material, such as copper, silver, or other metals. The terminal 106 includes a mating interface portion 170 and a crimp barrel portion 172. The crimp barrel portion 172 of the terminal 106 is crimped around the wire assembly 104. The mating interface portion 170 is configured to engage and electrically connect to a conductor within the connector housing, such as to a mating contact of a mating connector or to a conductor on a circuit board. The mating interface portion 170 in the illustrated embodiment has a cylindrical shape, and may be a pin. In an alternative embodiment, the mating interface portion 170 may have a box-shape, a curled B-shape, or the like. During the crimping operation, the wire assembly 104 is loaded into or onto the crimp barrel portion 172 of the terminal 106, to the position shown in FIG. 3. The crimp barrel portion 172 includes a wire barrel 174 and a seal barrel 176. The wire barrel 174 aligns with and is crimped to the distal portion 158 of the wire 120. The seal barrel 176 aligns with and is crimped to the crimp segment 160 of the compression seal 122. Once the terminal 106 is crimped to the wire assembly 104, the seal 122 is fixed in place on the resulting electrical lead.

Figure 4:
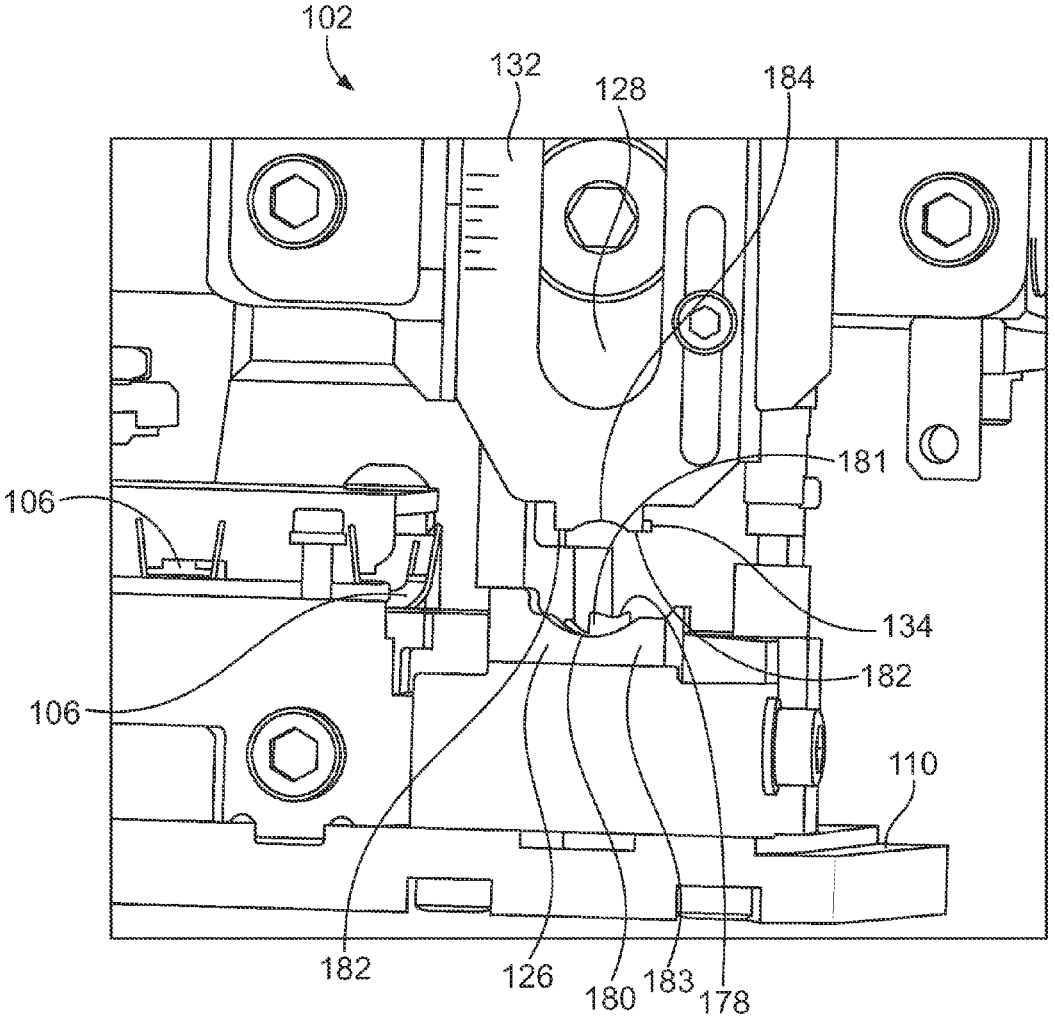
FIG. 4 is a front perspective view of a portion of the terminal crimping device according to another embodiment.

FIG. 4 is a front perspective view of a portion of the terminal crimping device 102 according to another embodiment. The embodiment shown in FIG. 4 may be similar to the embodiment shown in FIGS. 1-3 except for the shape of the contact tab 134 of the seal depressor 132. Instead of being flat as shown in FIG. 2, the contact tab 134 in FIG. 4 is curved in a concave shape relative to the base 126. For example, side edges 182 of the contact tab 134 are located closer to the base 126 than a horizontal midpoint 184 of the contact tab 134.

The base 126, on which the wire assembly 104 (shown in FIG. 1) and the terminal 106 are received, includes a wire support surface 178 and a seal support surface 180. The wire support surface 178 receives the distal portion 158 (shown in FIG. 3) of the wire 120 (FIG. 3) thereon. The distal portion 158 may indirectly engage the wire support surface 178 via the terminal 106, which sits directly on the wire support surface 178 and on which the distal portion 158 of the wire 120 is received. The seal support surface 180 receives the compression seal 122 (FIG. 3) thereon. Optionally, the wire support surface 178 is not co-planar with the seal support surface 180. For example, the wire support surface 178 may be disposed vertically (for example, along the ram axis 127 shown in FIG. 1) more proximate to the crimp tooling 128 than is the seal support surface 180. Put another way, the seal support surface 180 is more proximate to the frame 110 (FIG. 1) than the proximity of the wire support surface 178 to the frame 110. As shown in FIG. 3, the compression seal 122 has a greater diameter than the distal portion 158 of the wire 120, so the wire and seal support surfaces 178, 180 are staggered vertically to support the respective components of the wire assembly 104.

During the crimp stroke, the seal depressor 132 moves towards and away from the seal support surface 180 of the base 126. The compression seal 122 (shown in FIG. 3) is captured between the contact tab 134 of the seal depressor 132 and the seal support surface 180 during the crimp forming stage of the crimp stroke, as described above with reference to FIG. 2. More specifically, the plug segment 162 (shown in FIG. 3) of the compression seal 122 is located on the seal support surface 180 and is captured between the contact tab 134 and the seal support surface 180. In the illustrated embodiment, the seal support surface 180 has a concave curve relative to the seal depressor 132 (and the wire assembly 104) above. The concave curve may accommodate the curved outer perimeter of the seal 122. The concave curve may prohibit the seal 122 from rolling away from a center position of the seal support surface 180 during the crimp forming stage. As described above, the contact tab 134 of the seal depressor 132 also may have a concave curve. The concave curve of the contact tab 134 is relative to the base 126 (and the wire assembly 104) below the seal depressor 132. Thus, the curve of the contact tab 134 may at least partially mirror the curve of the seal support surface 180. Like the curve of the seal support surface 180, the concave shape of the contact tab 134 may be configured to accommodate the curved shape of the seal 122 to increase the contact surface between the tab 134 and the seal 122 to hold the seal 122 in place during the crimp forming stage.

In an embodiment, the base 126 includes an anvil 181 and a shear 183. The anvil 181 defines the wire support surface 178. The shear 183 defines the seal support surface 180. The anvil 181 is located rearward of the shear 183 (for example, relative to the wire loading direction 129 shown in FIG. 1). Optionally, the anvil 181 is stationary relative to the frame 110 throughout the crimp stroke, while the shear 183 is floatable (or movable) vertically during the crimp stroke, as described below. For example, the shear 183 may be coupled to the frame 110 via one or more compression springs, which allow the shear 183 to float and be depressible towards the frame 110 below. In an alternative embodiment, the base 126 is a single, discrete component that integrally defines both the wire support surface 178 and the seal support surface 180.

Figure 5:
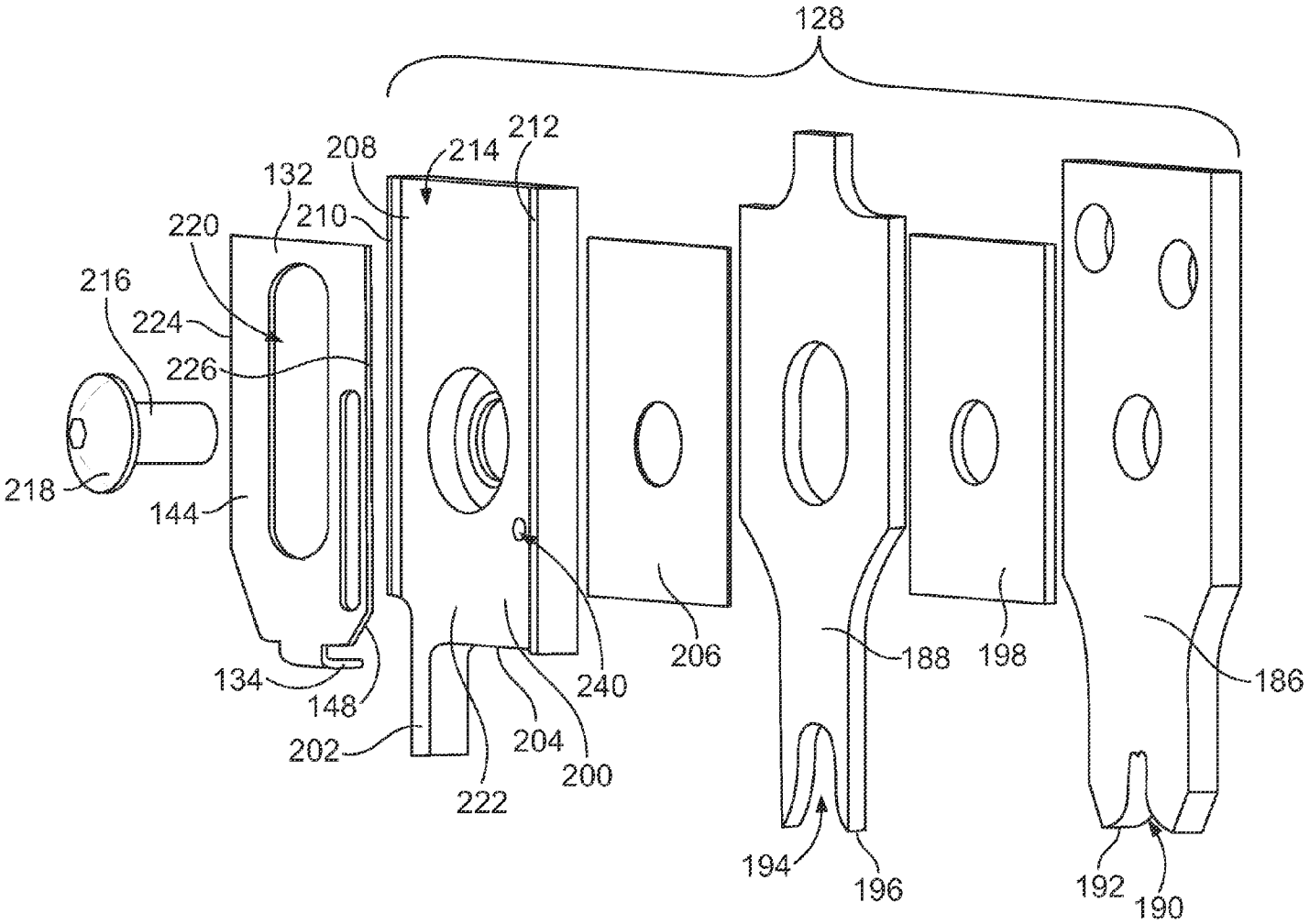
FIG. 5 is an exploded view of a seal depressor and crimp tooling according to an embodiment.

FIG. 5 is an exploded view of the seal depressor 132 and the crimp tooling 128 according to an embodiment. The crimp tooling 128 includes a wire crimp tool 186 and a seal crimp tool 188. With additional reference to FIG. 3, the wire crimp tool 186 includes a roll profile 190 at a bottom 192 thereof that engages and forms the wire barrel 174 of the terminal 106 around the distal portion 158 of the wire 120. The seal crimp tool 188 also includes a roll profile 194 at a bottom 196 thereof that engages and forms the seal barrel 176 of the terminal 106 around the crimp segment 160 of the compression seal 122. The wire crimp tool 186 and the seal crimp tool 188 are separated from one other by a first spacer 198. The first spacer 198 has a thickness selected to properly space the two crimp tools 186, 188 with respect to the terminal 106. The seal crimp tool 188 is frontward of the wire crimp tool 186. Optionally, the ram 124 (shown in FIG. 1) is disposed rearward of the crimp tooling 128. For example, the wire crimp tool 186 may be coupled to the ram 124. The seal depressor 132 is disposed frontward of the crimp tooling 128. For example, the seal depressor 132 may be coupled to a front side 208 of the crimp tooling 128.

Optionally, the crimp tooling 128 includes a shear depressor 200. The shear depressor 200 includes a leg 202 extending downward from a bottom 204 thereof. During the crimping operation, the leg 202 strikes a portion of the carrier strip (not shown) and/or the shear 183 (FIG. 4). The force of the shear depressor 200 on the carrier strip and/or the shear 183 may cause the shear 183 to depress vertically downwards towards the frame 110 (FIG. 1), which severs (or shears) the terminal 106 (FIG. 1) in the crimping zone 112 (FIG. 1) from the carrier strip, separating the terminal 106 from the terminal strip 116 (FIG. 1). The shear depressor 200 may be located frontward of the seal crimp tool 188. The shear depressor 200 in the illustrated embodiment is separated from the seal crimp tool 188 by a second spacer 206. The thickness of the second spacer 206 is selected to properly space the shear depressor 200 and the seal crimp tool 188 with respect to the terminal 106.

The components of the crimp tooling 128 are held together via a bolt 216. The bolt 216 extends rearward from the front side 208 of the crimp tooling 128 through defined apertures in the components of the crimp tooling 128. The bolt 216 is received in and fixed to an opening in the ram 124 (shown in FIG. 1). The components of the crimp tooling 128 are held together between the ram 124 and a head 218 of the bolt 216. The seal depressor 132 may define a window 220 that allows the head 218 of the bolt 216 to extend through the plane of the body 144 of the seal depressor 132, as shown in FIG. 2, without engaging the seal depressor 132. In an alternative embodiment, the head 218 of the bolt 216 engages the seal depressor 132 and holds the seal depressor 132 against the front side 208 of the crimp tooling 128.

In an embodiment, the front side 208 of the crimp tooling 128 includes first and second side rails 210, 212. In the illustrated embodiment, the side rails 210, 212 are located on the shear depressor 200. In alternative embodiments, the side rails 210, 212 may be located on another component of the crimp tooling 128. The side rails 210, 212 extend parallel to the ram axis 127 (shown in FIG. 1) and define a track 214 between the two side rails 210, 212. When coupled to the crimp tooling 128, the seal depressor 132 is held between the side rails 210, 212 in the track 214. For example, a left edge 224 of the seal depressor 132 engages the first side rail 210, and a right edge 226 of the seal depressor 132 engages the second side rail 212. The side rails 210, 212 restrict rotation of the seal depressor 132, but allow for vertical translational movement of the seal depressor 132 relative to the crimp tooling 128.

The rear face 148 of the seal depressor 132 may be configured to abut the front side 208 of the crimp tooling 128, such as a front surface 222 of the shear depressor 200. The contact tab 134 extends rearward from the seal depressor 132 under the bottom 204 of the shear depressor 200. Optionally, the seal depressor 132 may be stamped and formed out of a panel of metal or the like. For example, the outline of the seal depressor 132 may be stamped in one plane, and the contact tab 134 is subsequently bent out of plane from the body 144 of the seal depressor 132. In an alternative embodiment, the seal depressor 132 may be formed by a molding process instead of being stamped and formed, and the seal depressor 132 may be molded from a metal, a plastic, or another moldable material.

Figure 6B:
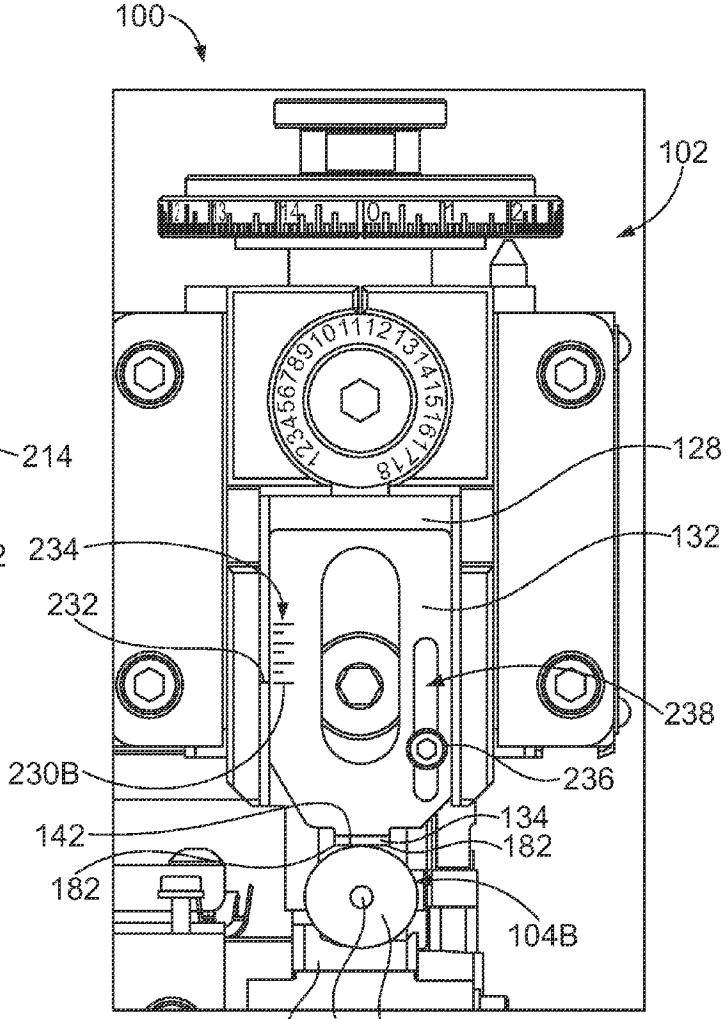
FIGS. 6A and 6B are front views of the crimping system with the seal depressor in two different operative positions relative to the crimp tooling on the terminal crimping device.
Figure 6A:
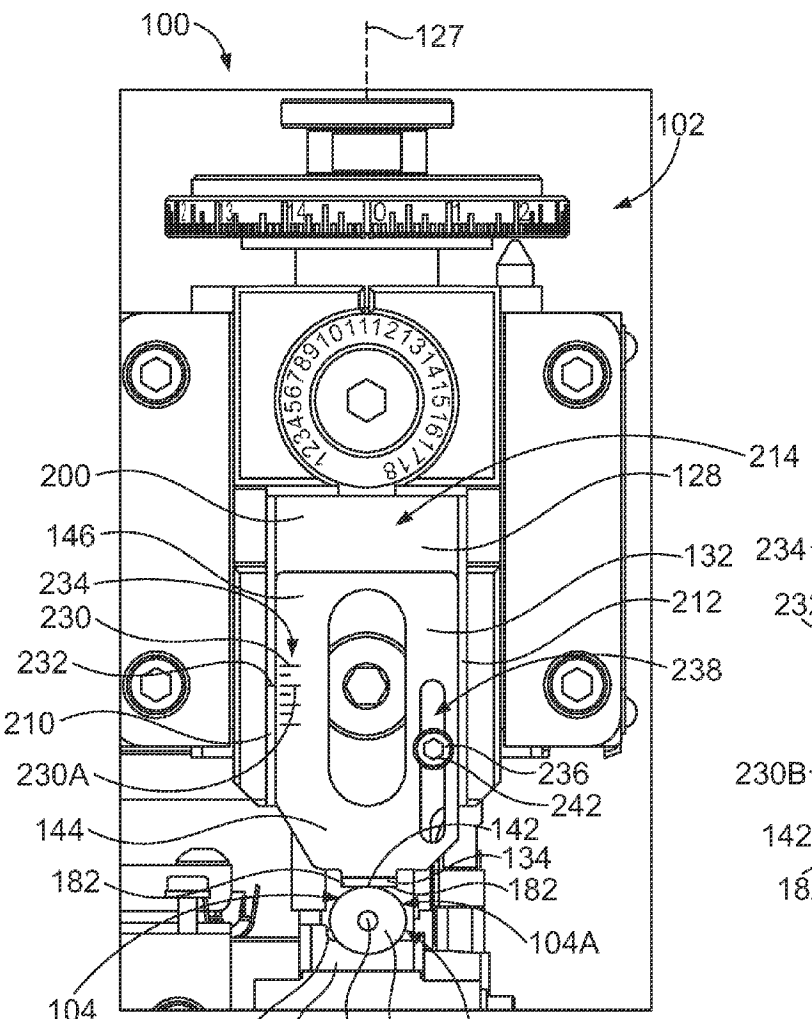

FIGS. 6A and 6B are front views of the crimping system 100 with the seal depressor 132 in two different operative positions relative to the crimp tooling 128 on the terminal crimping device 102. In an exemplary embodiment, the seal depressor 132 is adjustable relative to the crimp tooling 128 along the rain axis 127 to adjust a bottom dead center position of the seal depressor 132 during the crimp stroke. The seal depressor 132 is adjustable in order to accommodate different wire assemblies 104 that have different sizes, shapes, and/or materials of the compression seal 122 and/or different sizes of wires 120. For example, the seal depressor 132 is adjustable to prevent damage to the seal 122 caused by over-depression of the seal 122 by the contact tab 134 of the seal depressor 132. In addition, the seal depressor 132 is adjustable to ensure that the contact tab 134 engages the seal 122 with sufficient force to hold the seal 122 in place during the crimping stage.

In FIG. 6A, the seal depressor 132 is in a first operative position relative to the crimp tooling 128, and in FIG. 6B, the seal depressor 132 is in a second operative position relative to the crimp tooling 128. The seal depressor 132 in the first operative position is more proximate to the base 126 than the seal depressor 132 in the second operative position. The seal depressor 132 in the first operative position shown in FIG. 6A accommodates a first wire assembly 104A that has a smaller outer diameter than a second wire assembly 104B shown in FIG. 6B. The seal depressor 132 in the first and second operative positions shown in FIGS. 6A and 6B, respectively, may be located in the bottom dead center position of the respective crimp stroke. The bottom dead center position of the seal depressor 132 in FIG. 6A is lower than the bottom dead center position in FIG. 6B because the diameter of the seal 122 of the first wire assembly 104A is less than the diameter of the second wire assembly 104B.

In an embodiment, the seal depressor 132 is adjustable relative to the crimp tooling 128 when the terminal crimping device 102 is not actively being used for a crimping operation. For example, the seal depressor 132 may be adjusted during set-up based on a known type and/or size of the wire assembly 104 that is going to be used in an upcoming crimping operation. Once the operative position of the seal depressor 132 relative to the crimp tooling 128 is selected, the seal depressor 132 is fixed to the crimp tooling 128 such that the seal depressor 132 moves with the crimp tooling 128 (and not relative to the crimp tooling 128) during the crimping operation.

Optionally, the seal depressor 132 and/or the crimp tooling 128 includes markings 230 that indicate pre-defined operative positions of the seal depressor 132 for use with different wire assemblies 104. For example, the front face 146 of the seal depressor 132 may include a marker set 234, such as a measurement scale, and the first side rail 210 of the crimp tooling 128 includes a reference marker 232. The marker set 234 may be calibrated with the height of the crimping zone 112 between the base 126 and the contact tab 134 of the seal depressor 132 and the diameters of known wire assemblies 104. For example, knowing the size and/or type of the first wire assembly 104A, the seal depressor 132 in FIG. 6A is adjusted such that the reference marker 232 aligns with the second full marking 230A from the top in the set 234. By comparison, knowing the larger size of the second wire assembly 104B, the seal depressor 132 in FIG. 6B is adjusted such that the reference marker 232 aligns with the bottom-most or fourth full marking 230B from the top in the set 234.

In an embodiment, the seal depressor 132 is configured to be manually adjusted relative to the crimp tooling 128, such as by an operator while setting up a crimping operation. In an alternative embodiment, the seal depressor 132 may be adjusted relative to the crimp tooling 128 automatically or autonomously via an electrical actuator. For example, the operator may input set-up information, such as the type of wire assembly 104, the size of the wire assembly 104, and/or the size of the seal 122, into a user interface device that communicates with an electrical actuator to autonomously adjust the position of the seal depressor 132 relative to the crimp tooling 128 to a pre-defined position associated with the input information.

In the illustrated embodiment, the seal depressor 132 is adjustably fixed to the crimp tooling 128 by a releasable locking fastener 236. The locking fastener 236 is movable between a locked state and an adjustable state. In the locked state, the locking fastener 236 fixes the seal depressor 132 in place relative to the crimp tooling 128. Thus, during the crimping operation, the locking fastener 236 is in the locked state such that the seal depressor 132 moves along the crimp stroke with the crimp tooling 128. In the adjustable state, the locking fastener 236 allows the seal depressor 132 to move relative to the crimp tooling 128. For example, when the locking fastener 236 is in the adjustable state, the seal depressor 132 may be adjustable vertically (along the ram axis 127) relative to the crimp tooling 128 to select a different operative position of the seal depressor 132. The seal depressor 132 may be adjusted by sliding the seal depressor 132 along the track 214 defined between the side rails 210, 212.

The releasable locking fastener 236 extends rearward through an elongated slot 238 in the body 144 of the seal depressor 132. The slot 238 may extend parallel to the ram axis 127. The locking fastener 236 extends from the front face 146 of the seal depressor 132, through the slot 238, and into a hole 240 (shown in FIG. 5) in the crimp tooling 128 (for example, in the shear depressor 200). The locking fastener 236 is configured to be fixed in place relative to the crimp tooling 128, such that, as the seal depressor 132 is adjusted, the seal depressor 132 is slidable relative to both the locking fastener 236 and the crimp tooling 128. The elongated slot 238 allows the seal depressor 132 to be moved relative to the fastener 236 when the fastener 236 is in the adjustable state. In an embodiment, the locking fastener 236 is a threaded bolt that is rotated to transition between locked and adjustable states. In the locked state, a head 242 of the bolt engages the front face 146 of the seal depressor 132 and forces the seal depressor 132 against the crimp tooling 128 to fix the seal depressor 132 to the crimp tooling 128. In the adjustable state, the threaded bolt is rotated such that the head 242 moves away from the crimp tooling 128 to decrease the force on the seal depressor 132, allowing the seal depressor 132 to move. In another embodiment, the locking fastener 236 may be a spring-loaded pin that engages notches (not shown) that may be defined along edges of the slot 238 in the locked state, and is pulled away from the notches in the adjustable state.

As shown in FIGS. 6A and 6B, the bottom surface 142 of the contact tab 134 is in engagement with the compression seals 122 of the respective wire assemblies 104A, 104B, and the compression seals 122 are at least partially depressed. The bottom surface 142 may be smooth and lacks apertures, jagged edges, protrusions, or other irregularities which may damage the compression seal 122. In an embodiment, the bottom surface 142 of the contact tab 134 has a surface area that is greater than a depressed contact surface of the compression seal 122, which is the portion of the compression seal 122 that engages the contact tab 134. For example, even when the seal depressor 132 is at the bottom dead center position and the seal 122 is depressed a maximum amount, the depressed contact surface of the compression seal 122 does not engage edges (for example, the side edges 182) of the contact tab 134. Thus, there is no risk of the compression seal 122 tearing on the edges of the contact tab 134 as the contact tab 134 depresses the seal 122.

As described above, the seal support surface 180 of the base 126 that receives the compression seal 122 thereon, may be defined by a floatable shear 183 (shown in FIG. 4). During a crimping operation, as the contact tab 134 engages the compression seal 122 and forces the seal 122 against the seal support surface 180, the shear 183 may depress relative to the frame 110 (shown in FIG. 1), which reduces the compressive forces applied on the seal 122. Reducing the compressive forces serves to reduce the risk of damaging or misaligning the compression seal 122 during the crimping operation.

In an alternative embodiment, even if the crimp tooling 128 does not include the shear depressor 200 and the base 126 does not include the shear 183, the portion of the base 126 that defines the seal support surface 180 may be configured to be depressible similar to the floating shear 183. In another alternative embodiment, the seal depressor 132 itself may include a biasing member that allows the seal depressor 132 to be depressible or deflectable to reduce compressive forces exerted on the seal 122. For example, the seal depressor 132 may include a top component and a bottom component that are coupled together via a biasing member, such as one or more compression springs, accordion-style ridges, or the like. The top component may include the slot 238 that receives the locking fastener 236, and the bottom component includes the contact tab 134. During the crimping operation, as the contact tab 134 engages the compression seal 122, the biasing member allows the bottom component to move relative to the top component, which reduces the forces applied on the compression seal 122 by the contact tab 134. Optionally, instead of or in addition to the biasing member, the contact tab 134 may be formed of, or at least the bottom surface 142 may be covered in, a soft and/or compressible material to reduce the forces applied on the compression seal 122.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A terminal crimping device that crimps a terminal to a wire assembly, the wire assembly including a wire and a compression seal on the wire, the terminal crimping device comprising:

crimp tooling on a movable ram, the crimp tooling moving with the movable ram along a crimp stroke towards and away from a base that receives the wire assembly thereon, the crimp tooling crimping the terminal to both the wire and the compression seal of the wire assembly during the crimp stroke; and a seal depressor adjustably fixed to the crimp tooling by a releasable locking fastener that is selectively operable between a locked state and an adjustable state, the locking fastener in the locked state fixing the seal depressor in place relative to the crimp tooling such that the seal depressor moves with the crimp tooling along the crimp stroke and does not move relative to the crimp tooling, the seal depressor having a contact tab that engages and at least partially depresses the compression seal of the wire assembly during the crimp stroke when the locking fastener is in the locked state to hold the compression seal in place as the crimp tooling crimps the terminal to the wire assembly, wherein the locking fastener in the adjustable state allows the seal depressor to move from a first operative position relative to the crimp tooling to a second operative position relative to the crimp tooling to adjust a bottom dead center position of the seal depressor, according to the size of the wire assembly, including the compression seal on the wire, as the crimp tooling moves along the crimp stroke.

2. The terminal crimping device of claim 1, wherein the contact tab of the seal depressor is flat.

3. The terminal crimping device of claim 1, wherein the contact tab of the seal depressor has a concave curve relative to the base.

4. The terminal crimping device of claim 1, wherein the seal depressor has a planar body having a front face and a rear face, the rear face facing the crimp tooling, the contact tab extending rearward from a bottom edge of the body towards the crimp tooling.

5. The terminal crimping device of claim 1, wherein the contact tab has a surface area greater than a depressed contact surface of the compression seal such that edges of the contact tab do not contact the compression seal as the contact tab engages and at least partially depresses the compression seal.

6. The terminal crimping device of claim 1, wherein the crimp tooling moves with the ram along a ram axis during the crimp stroke, the crimp tooling having first and second side rails extending parallel to the ram axis and defining a track between the first and second side rails, the seal depressor held between the first and second side rails in the track.

7. The terminal crimping device of claim 1, wherein the crimp tooling moves with the ram along a ram axis during the crimp stroke, the seal depressor defining an elongated slot that extends parallel to the ram axis, the locking fastener extending through the slot into the crimp tooling, the locking fastener being fixed in place relative to the crimp tooling, the seal depressor being movable relative to the locking fastener along the slot when the locking fastener is in the adjustable state.

8. The terminal crimping device of claim 7, wherein the seal depressor includes markings adjacent to the elongated slot that indicate pre-defined operative positions of the seal depressor for different wire assemblies.

9. The terminal crimping device of claim 1, wherein the crimp tooling includes a wire crimp tool, a seal crimp tool, and a shear depressor, the wire crimp tool crimping a wire barrel of the terminal to the wire, the seal crimp tool crimping a seal barrel of the terminal to the seal, the shear depressor separating the terminal from a carrier strip.

10. The terminal crimping device of claim 1, wherein the base has a wire support surface and a seal support surface, the wire support surface receiving a distal portion of the wire thereon, the seal support surface receiving the compression seal thereon, the wire support surface being non-coplanar with the seal support surface, the wire support surface disposed vertically more proximate to the crimp tooling than the seal support surface.

11. The terminal crimping device of claim 1, wherein the base includes an anvil and a shear, the anvil defining a wire support surface that receives a distal portion of the wire thereon, the shear defining a seal support surface that receives the compression seal thereon, wherein the seal depressor moves towards and away from the shear during the crimp stroke, the compression seal being captured between the contact tab of the seal depressor and the seal support surface during a crimp forming stage of the crimp stroke.

12. The terminal crimping device of claim 1, wherein the contact tab of the seal depressor engages a plug segment of the compression seal, the crimp tooling forming the terminal around a crimp segment of the compression seal, the crimp segment being proximate to a distal end of the wire, the plug segment having a greater diameter than the crimp segment.

13. A crimping system comprising:

a wire assembly that includes a wire and a compression seal on the wire; and a terminal crimping device that crimps a terminal to the wire assembly, the terminal crimping device comprising:

a base that receives the wire assembly thereon such that the wire assembly is oriented along a wire axis, the base having a seal support surface that receives the compression seal of the wire assembly thereon, the seal support surface having a concave curve relative to the wire assembly, the concave curve elongated along a longitudinal axis parallel to the wire axis to prohibit the compression seal from moving laterally from a center position on the seal support surface;

crimp tooling on a movable ram, the crimp tooling moving with the movable ram along a crimp stroke towards and away from the base, the crimp tooling forming the terminal around both the wire and the compression seal of the wire assembly during the crimp stroke; and a seal depressor adjustably fixed to the crimp tooling by a releasable locking fastener, the releasable locking fastener selectively allowing the seal depressor to move with the crimp tooling along the crimp stroke and not move relative to the crimp tooling, the seal depressor having a contact tab that engages and at least partially depresses the compression seal of the wire assembly against the seal support surface of the base during the crimp stroke to hold the compression seal in place as the crimp tooling forms the terminal around the wire assembly.

14. The crimping system of claim 13, wherein the crimp tooling includes a wire crimp tool and a seal crimp tool, the wire crimp tool forming the terminal around the wire, the seal crimp tool forming the terminal around the compression seal.

15. The crimping system of claim 13, wherein the contact tab of the seal depressor also has a concave curve relative to the wire assembly on the base, the concave curve of the contact tab mirroring the concave curve of the seal support surface to accommodate a curved outer perimeter of the compression seal.

16. The crimping system of claim 15, wherein the releasable locking fastener fixes the seal depressor in place relative to the crimp tooling when the locking fastener is in a locked state such that the seal depressor moves with the crimp tooling along the crimp stroke and does not move relative to the crimp tooling, the locking fastener in an adjustable state allowing the seal depressor to slide linearly from a first operative position relative to the crimp tooling to a second operative position relative to the crimp tooling to adjust a bottom dead center position of the seal depressor along the crimp stroke.

17. The crimping system of claim 16, wherein the seal depressor has a planar body including a front face and a rear face, the rear face facing a front side of the crimp tooling, wherein, in the locked state, a head of the locking fastener engages the front face of the body and forces the rear face against the front side of the crimp tooling to fix the seal depressor to the crimp tooling.

18. The terminal crimping device of claim 1, wherein the seal depressor has a planar body including a front face and a rear face, the rear face facing a front side of the crimp tooling, wherein, in the locked state, a head of the locking fastener engages the front face of the body and forces the rear face against the front side of the crimp tooling to fix the seal depressor to the crimp tooling.

19. The terminal crimping device of claim 1, wherein the seal depressor has a planar body including a front face and a rear face, the rear face facing a front side of the crimp tooling, the contact tab extending rearward from the body across at least a portion of the crimp tooling.

20. The terminal crimping device of claim 1, further comprising the base that receives the wire assembly thereon such that the wire assembly is oriented along a wire axis, the base having a seal support surface that receives the compression seal of the wire assembly thereon, the seal support surface having a concave curve relative to the wire assembly, the concave curve elongated along a longitudinal axis parallel to the wire axis to prohibit the compression seal from moving laterally from a center position on the seal support surface.

* * * * *